US009628923B2

(12) United States Patent
Van Der Werf

(10) Patent No.: US 9,628,923 B2
(45) Date of Patent: Apr. 18, 2017

(54) FEEDBACK SUPPRESSION

(71) Applicant: GN ReSound A/S, Ballerup (DK)

(72) Inventor: Erik Cornelis Diederik Van Der Werf, Eindhoven (NL)

(73) Assignee: GN Hearing A/S, Ballerup (DK)

( * ) Notice: Subject to any disclaimer, the term of this patent is extended or adjusted under 35 U.S.C. 154(b) by 177 days.

(21) Appl. No.: 14/144,474

(22) Filed: Dec. 30, 2013

(65) Prior Publication Data

US 2015/0189450 A1 Jul. 2, 2015

(30) Foreign Application Priority Data

Dec. 27, 2013 (DK) ..... 2013 70822
Dec. 27, 2013 (EP) ..... 13199680

(51) Int. Cl.
*H04R 25/00* (2006.01)

(52) U.S. Cl.
CPC ..... *H04R 25/453* (2013.01); *H04R 25/45* (2013.01); *H04R 25/456* (2013.01)

(58) Field of Classification Search
CPC ..... H04R 25/45; H04R 25/453; H04R 25/456
USPC ..... 381/318
See application file for complete search history.

(56) References Cited

U.S. PATENT DOCUMENTS 6,563,931 B1 * 5/2003 Soli ..... H04R 25/505 381/318
8,655,001 B1 * 2/2014 Goldstein ..... H04R 25/453 381/312
2001/0002930 A1 * 6/2001 Kates ..... 381/317
2011/0150250 A1 * 6/2011 Pape et al. ..... 381/313
2011/0293124 A1 * 12/2011 Ma ..... H04R 25/453 381/318
2012/0148078 A1 * 6/2012 Junius et al. ..... 381/318
2013/0259277 A1 * 10/2013 Kojima et al. ..... 381/317
2014/0364681 A1 * 12/2014 Hillbratt ..... H04R 25/30 600/25

FOREIGN PATENT DOCUMENTS

| | | |
|---|---|---|
| DE | 102009060094 | 6/2011 |
| EP | 0342782 | 3/1989 |
| EP | 1874082 | 1/2008 |
| EP | 2391145 | 11/2011 |
| WO | WO 99/26453 | 5/1999 |
| WO | WO 03/015468 | 2/2003 |

OTHER PUBLICATIONS

Extended European Search Report for EP Patent Application No. 13199680.3, dated Mar. 24, 2014 (7 pages).
First Technical Examination for DK Patent Application No. PA 2013 70822, dated Mar. 13, 2014 (7 pages).
Communication pursuant to Article 94(3) EPC dated Apr. 28, 2016 for corresponding European Patent Application No. 13199680.3, 4 pages.

* cited by examiner

*Primary Examiner* — Duc Nguyen
*Assistant Examiner* — Sean H Nguyen
(74) *Attorney, Agent, or Firm* — Vista IP Law Group, LLP

(57) ABSTRACT

A new method for performing adaptive feedback suppression in a hearing aid and a hearing aid utilizing the method are provided. According to the method, a slow adaptive filter and a fast adaptive filter with different error signals for filter coefficient updating are used for feedback suppression.

14 Claims, 13 Drawing Sheets

FEEDBACK SUPPRESSION

RELATED APPLICATION DATA

This application claims priority to and the benefit of European Patent Application No. 13199680.3, filed on Dec. 27, 2013, pending, and Danish Patent Application No. PA 2013 70822, filed on Dec. 27, 2013, pending. The entire disclosures of both of the above application are expressly incorporated by reference herein.

FIELD

A new method for performing adaptive feedback suppression in a hearing aid and a hearing aid utilizing the method are provided. According to the method, feedback suppression is performed with a slow adaptive filter modelling slow changes of a feedback path and a fast adaptive filter modelling rapid changes of the feedback path.

BACKGROUND

In a hearing aid, acoustical signals arriving at a microphone of the hearing aid are amplified and output with a small loudspeaker to restore audibility. The small distance between the microphone and the loudspeaker may cause feedback. Feedback is generated when a part of the amplified acoustic output signal propagates back to the microphone for repeated amplification. When the feedback signal exceeds the level of the original signal at the microphone, the feedback loop becomes unstable, typically leading to audible distortions or howling. One way to stop feedback is to lower the gain.

The risk of feedback, limits the maximum gain that can be used with a hearing aid.

It is well-known to use feedback suppression in a hearing aid. With feedback suppression, the feedback signal arriving at the microphone is suppressed by subtraction of a feedback model signal from the microphone signal. The feedback model signal is provided by a digital feedback suppression circuit configured to model the feedback path of propagation along which an output signal of the hearing aid propagates back to an input of the hearing aid for repeated amplification. The transfer function of the receiver (in the art of hearing aids, a loudspeaker of the hearing aid is usually denoted the receiver), and the transfer function of the microphone are included in the model of the feedback path of propagation.

Typically, the digital feedback suppression circuit includes one or more digital adaptive filters to model the feedback path. An output of the feedback suppression circuit is subtracted from the audio signal of the microphone to remove the feedback signal part of the audio signal.

In a hearing aid with more than one microphone, e.g. having a directional microphone system, the hearing aid may comprise separate digital feedback suppression circuits for individual microphones and groups of microphones.

WO 99/26453 A1 provides a useful review of methods of feedback suppression in hearing aids.

WO 99/26453 A1 discloses feedback suppression with two adaptive filters connected in series, see FIG. 1.

The first filter is adapted during fitting of the hearing aid to the intended user and/or when the hearing aid is turned on in the ear. This filter adapts quickly using a white noise probe signal, and then the filter coefficients are frozen, i.e. during normal operation of the hearing aid; the first filter operates as a fixed filter.

The first filter models those parts of the hearing aid feedback path that are assumed to be essentially constant while the hearing aid is in use, such as the microphone, amplifier driving the receiver, and receiver resonances, and the basic acoustic feedback path.

The second filter adapts while the hearing aid is in use and does not use a separate probe signal. This filter provides a rapid correction to the feedback suppression circuit when the hearing aid goes unstable, and tracks perturbations in the feedback path that occur in daily use, such as caused by chewing, sneezing, or using a telephone handset.

The series connection of a fixed filter and an adaptive filter provides a good trade-off between speed and accuracy. A single long filter tends to be slow and/or inaccurate. Further, the fixed filter is an IIR-filter with relatively low processor requirements.

However, in practice the filter coefficients of the fixed filter are determined for each individual user when the hearing aid is fitted to the user by a dispenser or another trained person. This not only requires an additional fitting step, but also fails to capture the true invariant part of the feedback path because the feedback path measured by the dispenser already includes some of the variant parts. For example, the fitting of the hearing aid in the ear canal is included in the invariant part, but it may be subject to changes, e.g. when the hearing aid is re-inserted in the ear.

WO 99/26453 A1 also mentions the possibility of allowing the first filter to adapt slowly to follow slow changes in the hearing aid, such as component drift. However, no further explanation on how to allow the first filter to slowly adapt, i.e. no method of adaptation for the slow adaptive filter, is disclosed in WO 99/26453 A1.

SUMMARY

According to some embodiments, methods of adapting a slowly adapting filter are proposed, whereby initialisation during fitting or during power-up of the hearing aid in order to determine values of filter coefficients is avoided.

A hearing aid is provided, comprising an input transducer for generating an audio signal, a feedback suppression circuit configured for modelling a feedback path of the hearing aid, a subtractor for subtracting an output signal of the feedback suppression circuit from the audio signal to form a feedback compensated audio signal, a hearing loss processor that is coupled to an output of the subtractor for processing the feedback compensated audio signal to perform hearing loss compensation, and preferably, an output transducer, preferably a receiver, that is coupled to an output of the hearing loss processor for providing a sound signal based on the processed feedback compensated audio signal, wherein the feedback suppression circuit comprises

- a slow adaptive filter with an input coupled to the hearing loss processor and an output, and
- a fast adaptive filter with an input coupled to the slow adaptive filter, and output.

The output of the fast adaptive filter may constitute an output of the feedback suppression circuit.

A transducer is a device that converts a signal in one form of energy to a corresponding signal in another form of energy. For example, the input transducer may comprise a microphone that converts an acoustic signal arriving at the microphone into a corresponding analogue audio signal in which the instantaneous voltage of the audio signal varies continuously with the sound pressure of the acoustic signal.

The input transducer may also comprise a telecoil that converts a magnetic field at the telecoil into a corresponding analogue audio signal in which the instantaneous voltage of the audio signal varies continuously with the magnetic field strength at the telecoil. Telecoils are typically used to increase the signal to noise ratio of speech from a speaker addressing a number of people in a public place, e.g. in a church, an auditorium, a theatre, a cinema, etc., or through a public address systems, such as in a railway station, an airport, a shopping mall, etc. Speech from the speaker is converted to a magnetic field with an induction loop system (also denoted "hearing loop"), and the telecoil is used to magnetically pick up the magnetically transmitted speech signal.

With a telecoil, feedback may be generated when the telecoil picks up a magnetic field generated by the hearing aid, e.g. generated by the receiver.

The input transducer may further comprise at least two spaced apart microphones, and a beamformer configured for combining microphone output signals of the at least two spaced apart microphones into a directional microphone signal, e.g. as is well-known in the art.

The input transducer may comprise one or more microphones and a telecoil and a switch, e.g. for selection of an omni-directional microphone signal, or a directional microphone signal, or a telecoil signal, either alone or in any combination, as the audio signal.

The output transducer preferably comprises a receiver, i.e. a small loudspeaker, which converts an analogue audio signal into a corresponding acoustic sound signal in which the instantaneous sound pressure varies continuously in accordance with the amplitude of the analogue audio signal.

Typically, the analogue audio signal is made suitable for digital signal processing by conversion into a corresponding digital audio signal in an analogue-to-digital converter whereby the amplitude of the analogue audio signal is represented by a binary number. In this way, a discrete-time and discrete-amplitude digital audio signal in the form of a sequence of digital values represents the continuous-time and continuous-amplitude analogue audio signal.

Throughout the present disclosure, a part of the audio signal generated by the hearing aid itself, e.g., as a result of sound, mechanical vibration, electromagnetic fields, etc, generated by the hearing aid, is termed the feedback signal part of the audio signal; or in short, the feedback signal.

The feedback suppression circuit is provided in the hearing aid in order to model the feedback path, i.e. desirably the feedback suppression circuit has the same transfer function as the feedback path itself so that an output signal of the feedback suppression circuit matches the feedback signal part of the audio signal as closely as possible.

A subtractor is provided for subtraction of the output signal of the feedback suppression circuit from the audio signal to form a feedback compensated audio signal in which the feedback signal part has been removed or at least reduced.

The feedback suppression circuit comprises an adaptive filter that tracks the current transfer function of the feedback path.

The feedback suppression circuit may comprise one or more electronic delays corresponding to the delay of the feedback signal propagating along the feedback path of the hearing aid.

The feedback suppression circuit may comprise at least one fixed filter configured for modelling stationary parts of the feedback path of the hearing aid.

The feedback suppression circuit may comprise at least one slow adaptive filter and at least one fast adaptive filter configured for modelling the feedback path.

The slow adaptive filter eliminates the need for initialisation of the feedback suppression circuit during fitting to the intended user or during power-up of the hearing aid.

Further, the slow adaptive filter improves the performance of the feedback suppression circuit with relation to slow changes of the feedback path, such as accumulation of ear wax, changes due to reinsertion of the hearing aid in the ear canal of the user, drift of electronic components of the hearing aid, etc. Thus, the slow adaptive filter may track changes taking place in minutes or even slower, while the fast adaptive filter may track changes, such as smiling, chewing, sneezing, using a telephone handset, etc, taking place in tens of milliseconds and up to seconds.

The filter coefficients of the slow adaptive filter may be based at least in part on a difference between the output signal of the slow adaptive filter and the audio signal.

The filter coefficients of the slow adaptive filter may be based at least in part on a difference between the output signal of the slow adaptive filter and the output signal of fast adaptive filter.

The filter coefficients of the slow adaptive filter may be based at least in part on a difference between an output signal of the slow adaptive filter and a weighted sum of the output signal of the fast adaptive filter and first audio signal.

In the following, the above components and signals of the hearing aid mentioned for the first time are denoted the first respective components and signals to distinguish them from the second respective components and signals mentioned below.

The hearing aid may further comprise a second input transducer for generating a second audio signal, a second feedback suppression circuit configured for modelling a second feedback path of the hearing aid, a second subtractor for subtracting a second output signal of the second feedback suppression circuit from the second audio signal to form a second feedback compensated audio signal, and wherein the hearing loss processor is coupled to the second subtractor for processing the second feedback compensated audio signal to perform hearing loss compensation, and wherein the second feedback suppression circuit comprises

- a second slow adaptive filter with an input coupled to the hearing loss processor; or, the first slow adaptive filter, and an output, and
- a second fast adaptive filter with an input coupled to the second slow adaptive filter, and an output.

The output of the second fast adaptive filter may constitute an output of second feedback suppression circuit.

In a hearing aid with a plurality of input transducers, e.g. a front and a rear microphone, the distances between the input transducers are usually small due to the small sizes of hearing aid housings. The feedback paths to individual input transducers proximate to each other are expected to have similar transfer functions and therefore one filter may be used to model one of the feedback paths to a respective one of the input transducers and simpler filters, in the following denoted "correction filters", may be used to model differences between the modelled feedback path and other feedback paths to respective other input transducers, whereby duplication of common features of the slow adaptive filters are substantially avoided. The feedback path differences may lead to sub-sample delays and minor shaping of the magnitude responses due to the small differences in physical distances between the output transducer and the input transducers in question.

Consequently, the primary purpose of the correction filters may be to implement a form of interpolation which ideally requires an anti-causal impulse response, since interpolation is desirably based on samples on both sides of the interpolated point. Normally such a filter is difficult to implement, but for the feedback suppression circuit this is possible due to a total bulk delay in the feedback loop of typically at least up to two blocks of samples. Some of this bulk delay can be used to provide the response a bit ahead of time so that the correction filters have sufficient information to perform the desired interpolation.

The idea of modelling differences in feedback paths may also be applied to the fast adaptive filters. Changes in the dynamic feedback paths may also cause sub-sample time differences in the feedback loop and may also cause minor shaping of the magnitude responses suitable for modelling by interpolation.

Electronic delays corresponding to the delays caused by propagation of signals along the feedback path may be arranged in the feedback suppression circuit. This simplifies the adaptive filters and also facilitates interpolation based on samples before and after the interpolation point in time.

Delays of the feedback suppression circuit corresponding to propagation delays along the corresponding feedback paths may be provided in the form of one common delay, preferably the shortest delay between the output transducer and one of the input transducers, and individual delays modelling the additional delay from the output transducer to the respective other input transducers.

The slow adaptive filter may be FIR filters which are less complex and more stable than IIR filters.

The output signals of the slow filters may be scaled, preferably scaled adaptively, using bit shifters. Scaling, such as adaptive scaling, maximizes precision, and optionally extends the coefficient range, and also makes arbitrary slow adaptation possible. Without adaptive scaling, an optimal step size may not be available for all feedback paths.

The filter coefficients of the second slow adaptive filter may be based at least in part on a difference between the output signal of the second slow adaptive filter and the second audio signal.

The filter coefficients of the second slow adaptive filter may be based at least in part on a difference between the output signal of the second slow adaptive filter and the output signal of second fast adaptive filter.

The filter coefficients of the second slow adaptive filter may be based at least in part on a difference between an output signal of the second slow adaptive filter and a weighted sum of the output signal of the second fast adaptive filter and the second audio signal.

A FIR filter architecture, with weight vector $\vec{w}$ and input vector $\vec{u}$, for calculating the output signal d, at time n is described as follows:

$$\vec{u}(n)=[u(n),u(n-1),\ldots,u(n-N_w+1)]^T \tag{1}$$

$$\vec{w}(n)=[w(n,1),w(n,2),\ldots,w(n,N_w)]^T \tag{2}$$

$$d(n)=\vec{w}(n)^T\vec{u}(n) \tag{3}$$

Convolving this signal with a fast adaptive filter $\vec{w}_f$, vectorizing d analogous to u and for simplicity disregarding a possible delay provides the output signal c of the fast adaptive filter, in the following denoted the cancellation signal c:

$$c(n)=\vec{w}_f(n)^T\vec{d}(n) \tag{4}$$

Input transducer audio samples s are assumed to be a mixture of an external signal x and feedback signal f, such that $$s(n)=x(n)+f(n) \tag{5}$$

and after feedback cancellation $$e(n)=s(n)-c(n)=x(n)+f(n)-c(n) \tag{6}$$

which provides perfect cancellation performance when f(n) equals c(n).

In principle, it is possible to adapt both the fast filter coefficients $\vec{w}_f$ and the slow filter coefficients $\vec{w}$ using a single error criterion.

However, in the following a more effective approach is disclosed that more fully exploit the fundamental differences in purpose of the slow and the fast adaptive filters, i.e. the slow filter desirably models properties of the feedback path subject to slow changes only, while the fast adaptive filter desirably models rapid changes only. Consequently, a different error criterion for the slow adaptive filter and the fast adaptive filter may be more appropriate.

Under normal circumstances, the cancellation signal c(n) may on average be assumed to be the best known estimate of the feedback signal, and therefore the slow adaptive filter may be connected for tracking this signal, thus absorbing innovations from the fast adaptive filter, which gives error signal $e_1$:

$$e_1(n)=c(n)-d(n) \tag{7}$$

Alternatively, a direct approach error signal defined as:

$$e_2(n)=s(n)-d(n) \tag{8}$$

which is effectively the signal that would be the output of the feedback suppression circuit, if the fast adaptive filter was frozen in its reference state.

Error signal $e_1$ is less sensitive to bias because the fast adaptive filter uses an adaptive signal model, but it may lead to local minima that may trap the slow adaptive filter preventing it for further adaptation.

Error signal $e_2$ is optimal for uncorrelated signals, but may suffer more from bias caused by tonal input.

Thus, another alternative is to use a weighted sum of the above-mentioned error signals $$\begin{aligned} e_m(n) &= (1-\beta)e_1(n)+\beta e_2(n) \\ &= (1-\beta)c(n)+\beta s(n)-d(n) \\ &= s(n)-(1-\beta)e(n)-d(n) \\ &= t(n)-d(n) \end{aligned} \tag{9}$$

where t(n) can be considered a target signal defined by the weighted sum.

β may be a fixed predetermined parameter.

A suitable quadratic error criterion, to be minimized, for processing a block of M samples can be formulated as $$J(n) = \frac{1}{2}\sum_{i=0}^{M-1} e_m(n-i)^2 \tag{10}$$

Using the chain rule to calculate gradient directions for minimizing J with respect to the slow adaptive filter coefficients then gives $$\nabla J(n)=\Sigma_{i=0}^{M-1} e_m(n-i)\nabla e_m(n-i) \tag{11}$$

where $$\nabla e_m=\nabla t(n)-\nabla d(n) \tag{12}$$

which for coefficients w, by ignoring the term ∇t(n) (the target should not depend on the current internal model), can be simplified to $$\nabla e_m(n)\approx-\nabla d(n)=-\overrightarrow{u(n)} \tag{13}$$

so that the gradient direction is estimated by cross-correlating the weighted error signal with the FIR filter input signal on respective taps.

Derivation for the front-to-rear correction filter coefficient may be analogous except that the cross correlation is now performed with the output signal of the common slow adaptive filter d(n), which is input to the correction filter.

For the slow and fast adaptive filters, the step size may be determined in a way well known in the art of adaptive filters, such as by the least mean squares (LMS) algorithm, the normalized least mean squares (NLMS) algorithm, or by line searches, conjugate gradients, Hessian estimation techniques, etc.

For the slow adaptive filter, however, a simple sign-based algorithm may be sufficient and an appropriate step size may be determined directly from the current filter coefficients.

In order to minimize complexity of the adjustment of the filter coefficients, only some of the coefficients, i.e. at least one coefficient, may be adjusted, i.e. updated, for each block of samples. Since only cross-correlations are used, the computational complexity for a single weight is roughly equivalent to that of adding a single FIR filter coefficient. Updating more than e.g. four filter coefficients per block may not be desired, at least for the slow adaptive filter.

Once an update cycle has been completed, i.e., all coefficients have been adjusted, i.e. updated, once, a special event is scheduled for updating administrative settings such as the coefficient step size, model scaling and constraints. For optimal accuracy, step-sizes and scaling have to be updated during normal operation of the hearing aid, because the feedback path magnitude is not known beforehand; however, a reasonable estimate may be provided to speed up initial convergence.

A good step size for the sign-based update is defined proportional to the feedback path magnitude response. Once, at least a rough indication of, the feedback magnitude is known, this approach provides nearly constant accuracy for tracking changes of the feedback path independent of the feedback signal level.

Another approach may be used directly after power up of the hearing aid, when the feedback path is not known yet. In the initial start-up phase, a faster, and initially even non-proportional, step size may be used to speed up convergence and quickly silence possible initial feedback, such as howling. The transition time from initial to final rate may be configurable, and may be in the order of a few seconds up to around a minute.

Alternatively, or in addition, a slow gain ramp-up and loading of coefficients previously stored in persistent memory may be performed.

In order to prevent adaptation of the slow adaptive filter in situations in which the slow adaptive filter may track misleading signals or signals with no information, one or more criteria for adaptation may be added for the slow adaptive filter, whereby the slow adaptive filter may be configured to adjust one or more of its filter coefficients only under certain conditions.

For example, the slow adaptive filter may only be configured to adjust one or more of its filter coefficients when (1) the signal level is above a predefined threshold, and/or, (2) the (direct error) signal and corresponding signal model are considered save for adaptation, and/or (3) the hearing aid is in its initial start-up phase (directly after power up).

The level threshold (1) primarily prevents adapting to meaningless input signals, e.g., microphone noise. This may also extend the start-up phase when the algorithm is booted in quiet or in a muted condition.

Regarding (2), the signal is considered save for adaptation when it is not too predictable, e.g. a pure tone is too predictable, which is determined by comparing the signal level of a de-correlated error signal, e.g. as used for updating the fast adaptive filter, with the level of the direct error signal itself.

Additionally or alternatively, the error signal is considered save when a p-norm, preferably the 1-norm, of the coefficient vector of the fast adaptive filter (representing the signal model) is below a predetermined threshold value (a large one-norm indicates tonal input).

The hearing aid may be a multi-band hearing aid performing hearing loss compensation differently in different frequency bands, thus accounting for the frequency dependence of the hearing loss of the intended user. In the multi-band hearing aid, the audio signal from the input transducer is divided into two or more frequency channels or bands; and, typically, the audio signal is amplified differently in each frequency band. For example, a compressor may be utilized to compress the dynamic range of the audio signal in accordance with the hearing loss of the intended user. In a multi-band hearing aid, the compressor performs compression differently in each of the frequency bands varying not only the compression ratio, but also the time constants associated with each band. The time constants refer to compressor attack and release time constants. The compressor attack time is the time required for the compressor to lower the gain at the onset of a loud sound. The release time is the time required for the compressor to increase the gain after the cessation of the loud sound.

The frequency bands may be warped frequency bands. For example, the hearing aid may have a compressor that performs dynamic range compression using digital frequency warping as disclosed in more detail in WO 03/015468, in particular the basic operating principles of a warped compressor are illustrated in FIG. 11 and the corresponding parts of the description of WO 03/015468.

The feedback suppression circuit, e.g. including one or more adaptive filters, may be a broad band model, i.e. the model may operate substantially in the entire frequency range of operation of the hearing aid, or in a significant part of the frequency range of the hearing aid, without being divided into a set of frequency bands.

Alternatively, the feedback suppression circuit may be divided into a set of frequency bands for individual modelling of the feedback path in each frequency band. In this case, the estimate of the residual feedback signal may be provided individually in each frequency band m of the feedback suppression circuit.

The frequency bands m of the feedback suppression circuit and the frequency bands k of the hearing loss compensation may be identical, but preferably, they are different, and preferably the number of frequency bands m of the feedback suppression circuit is less than the number of frequency bands of the hearing loss compensation.

Throughout the present disclosure, the term audio signal is used to identify any analogue or digital signal forming part of the signal path from an output of the microphone to an input of the hearing loss processor.

The feedback suppression circuit may be implemented as one or more dedicated electronic hardware circuits or may form part of a signal processor in combination with suitable signal processing software, or may be a combination of dedicated hardware and one or more signal processors with suitable signal processing software.

Signal processing in the new hearing aid may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A hearing aid includes: a first input transducer for generating a first audio signal; a first feedback suppression circuit configured for modelling a first feedback path of the hearing aid; a first subtractor for subtracting a first output signal of the first feedback suppression circuit from the first audio signal to form a first feedback compensated audio signal; a hearing loss processor that is coupled to the first subtractor for processing the first feedback compensated audio signal to perform hearing loss compensation; and a receiver that is coupled to the hearing loss processor for providing a sound signal based on the processed first feedback compensated audio signal, wherein the first feedback suppression circuit comprises a first slow adaptive filter with an input coupled to the hearing loss processor, and an output, and a first fast adaptive filter with an input coupled to the first slow adaptive filter, and an output, wherein filter coefficients of the first slow adaptive filter are based at least in part on a difference between an output signal of the first slow adaptive filter and at least one of an output signal of the first fast adaptive filter and the first audio signal.

Optionally, the filter coefficients of the first slow adaptive filter are based on a difference between the output signal of the first slow adaptive filter and the first audio signal.

Optionally, the filter coefficients of the first slow adaptive filter are based on a difference between the output signal of the first slow adaptive filter and the output signal of first fast adaptive filter.

Optionally, the filter coefficients of the first slow adaptive filter are based on a difference between the output signal of the first slow adaptive filter and a weighted sum of the output signal of the first fast adaptive filter and the first audio signal.

Optionally, the hearing aid further includes: a second input transducer for generating a second audio signal; a second feedback suppression circuit configured for modelling a second feedback path of the hearing aid; a second subtractor for subtracting a second output signal of the second feedback suppression circuit from the second audio signal to form a second feedback compensated audio signal; wherein the hearing loss processor is coupled to the second subtractor for processing the second feedback compensated audio signal to perform hearing loss compensation; and wherein the second feedback suppression circuit comprises a second slow adaptive filter with an input coupled to the hearing loss processor, and an output, and a second fast adaptive filter with an input coupled to the second slow adaptive filter, and an output, wherein filter coefficients of the second slow adaptive filter are based at least in part on a difference between an output signal of the second slow adaptive filter and at least one of an output signal of the second fast adaptive filter and the second audio signal.

Optionally, the hearing aid further includes: a second input transducer for generating a second audio signal; a second feedback suppression circuit configured for modelling a second feedback path of the hearing aid; a second subtractor for subtracting a second output signal of the second feedback suppression circuit from the second audio signal to form a second feedback compensated audio signal; wherein the hearing loss processor is coupled to the second subtractor for processing the second feedback compensated audio signal to perform hearing loss compensation; and wherein the second feedback suppression circuit comprises: a second slow adaptive filter with an input coupled to the first slow adaptive filter, and an output, and a second fast adaptive filter with an input coupled to the second slow adaptive filter, and an output, wherein filter coefficients of the second slow adaptive filter are based at least in part on a difference between an output signal of the second slow adaptive filter and at least one of an output signal of the second fast adaptive filter and the second audio signal.

Optionally, the filter coefficients of the second slow adaptive filter are based on a difference between the output signal of the second slow adaptive filter and the second audio signal.

Optionally, the filter coefficients of the second slow adaptive filter are based on a difference between the output signal of the second slow adaptive filter and the output signal of second fast adaptive filter.

Optionally, the filter coefficients of the second slow adaptive filter are based on a difference between the output signal of the second slow adaptive filter and a weighted sum of the output signal of the second fast adaptive filter and the second audio signal.

Optionally, the first slow adaptive filter is configured to adjust one or more of the filter coefficients when at least one criteria is fulfilled.

Optionally, the at least one criteria comprises a signal level of an input signal of the first feedback suppression circuit being larger than a predefined threshold.

Optionally, the at least one criteria comprises an autocorrelation of an error signal being below a predetermined threshold.

Optionally, the at least one criteria comprises that updating constitutes a first update performed immediately upon power-up of the hearing aid.

Optionally, the at least one criteria comprises a p-norm of a filter coefficient vector of the first fast adaptive filter being less than a predetermined threshold value.

Other and further aspects and features will be evident from reading the following detailed description of the embodiments.

BRIEF DESCRIPTION OF THE DRAWINGS

Below, the new method and hearing aid are explained in more detail with reference to the drawings in which various examples are shown. In the drawings.

DETAILED DESCRIPTION

Figure 1:
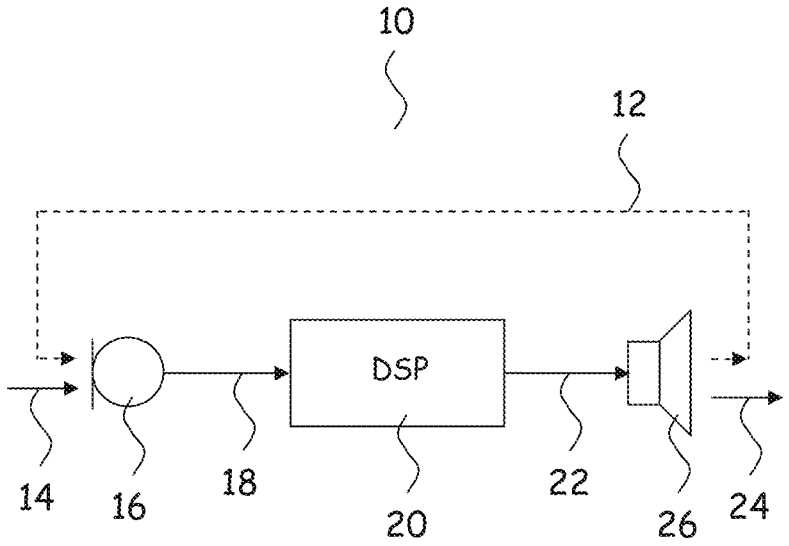
FIG. 1 schematically illustrates a hearing aid with a feedback path.

The drawings illustrate the design and utility of embodiments, in which similar elements are referred to by common reference numerals. Like elements may, thus, not be described in detail with respect to the description of each figure. In order to better appreciate how the above-recited and other advantages and objects are obtained, a more particular description of the embodiments will be rendered, which are illustrated in the accompanying drawings. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated or explicitly described.

The new hearing aid according to the appended claims may be embodied in different forms not shown in the accompanying drawings and should not be construed as limited to the examples set forth herein.

FIG. 1 schematically illustrates a hearing aid 10 and a feedback path 12 along which signals generated by the hearing aid 10 propagates back to an input of the hearing aid 10.

In FIG. 1, an acoustical signal 14 is received at a microphone 16 that converts the acoustical signal 14 into an audio signal 18 that is input to the hearing loss processor 20 for hearing loss compensation. In the hearing loss processor 20, the audio signal 18 is amplified in accordance with the hearing loss of the user. The hearing loss processor 20 may for example comprise a multi-band compressor. The output signal 22 of the hearing loss processor 20 is converted into an acoustical output signal 24 by the receiver 26 that emits the acoustical signal towards the eardrum of the user when the hearing aid 10 is worn in its proper operational position at an ear of the user.

Typically, a part of the acoustical signal 24 from the receiver 26 propagates back to the microphone 16 as indicated by feedback path 12 in FIG. 1.

At low gains, feedback only introduces harmless colouring of sound. However, with large hearing aid gain, the feedback signal level at the microphone 16 may exceed the level of the original acoustical signal 14 thereby causing audible distortion and possibly howling.

Figure 2:
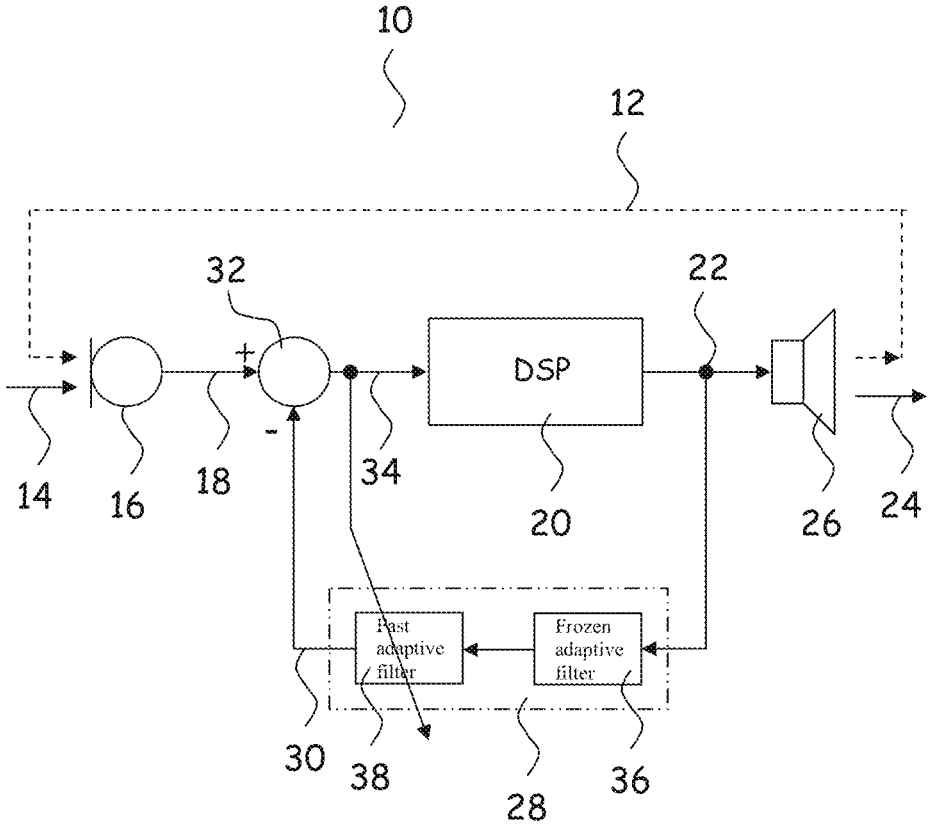
(Prior art) Fig. 2
FIG. 2 schematically illustrates a prior art hearing aid with feedback suppression, FIG. 3 schematically illustrates a new hearing aid with feedback suppression, FIG. 4 schematically illustrates another new hearing aid with feedback suppression, FIG. 5 schematically illustrates yet another new hearing aid with feedback suppression, FIG. 6 schematically illustrates still another new hearing aid with feedback suppression, FIG. 7 schematically illustrates yet still another new hearing aid with feedback suppression, FIG. 8 schematically illustrates yet still another new hearing aid with feedback suppression, FIG. 9 schematically illustrates another new hearing aid with feedback suppression having a fast adaptive filter with signal modelling circuitry, FIG. 10 schematically illustrates signal modelling circuitry in more detail, FIG. 11 schematically illustrates part of a new feedback suppression circuit.

To overcome feedback, it is well-known to provide feedback suppression circuitry in a hearing aid as shown in FIG. 2.

FIG. 2 schematically illustrates a hearing aid 10 with a feedback suppression circuit 28. The feedback suppression circuit 28 models the feedback path 12, i.e. the feedback suppression circuit seeks to generate a signal that is identical to the signal propagated along the feedback path 12. It is noted that the feedback suppression circuit 28 includes models of the receiver 26 and the microphone 16 so that the transfer function of the feedback suppression circuit 28 desirably equals the sum of the transfer function of the receiver 26, the transfer function of the feedback path 12, and the transfer function of the microphone 16.

The feedback suppression circuit 28 generates an output signal 30 to the subtractor 32 in order to suppress or cancel the feedback signal part of the audio signal 18 before processing takes place in the hearing loss processor 20.

In a conventional hearing aid 10, the feedback suppression circuit 28 is typically an adaptive digital filter which adapts to changes in the feedback path 12.

WO 99/26453 A1 discloses feedback suppression with a series connection of two adaptive filters. A first filter 36 is adapted when the hearing aid is fitted to the intended user at a dispenser's office. During the fitting, the filter 36 adapts quickly using a white noise probe signal, and then the filter coefficients are frozen, i.e. subsequently, during normal operation of the hearing aid, the first filter 36 operates as a fixed filter 36.

The first filter 36 models those parts of the hearing aid feedback path 12 that are assumed to be essentially constant while the hearing aid 10 is in use, such as the transfer function of the microphone 16, and the transfer function of the receiver 26, and a basic part of the feedback path 12.

The second filter 38 adapts while the hearing aid 10 is in use and does not use a separate probe signal. This filter 38 provides a rapid correction of the feedback suppression circuit 28 when the hearing aid 10 goes unstable, and tracks perturbations in the feedback path 12 that occur in daily use, such as caused by chewing, sneezing, or using a telephone handset. Thus, the fast adaptive filter 38 may track changes taking place in tens of milliseconds up to seconds.

Apart from requiring an extra fitting step, the fixed filter 26 fails to capture the true invariant part of the modelled transfer functions, because the determined fixed filter coefficients already include some of the variant parts. For example, the fitting of the hearing aid 10 in the ear canal is included in the invariant part, but it may be subject to changes, e.g. when the hearing aid 10 is re-inserted in the ear.

In the following, new hearing aids are illustrated that do not require an additional fitting step and also copes with the true variant parts of the modelled transfer functions.

Figure 3:
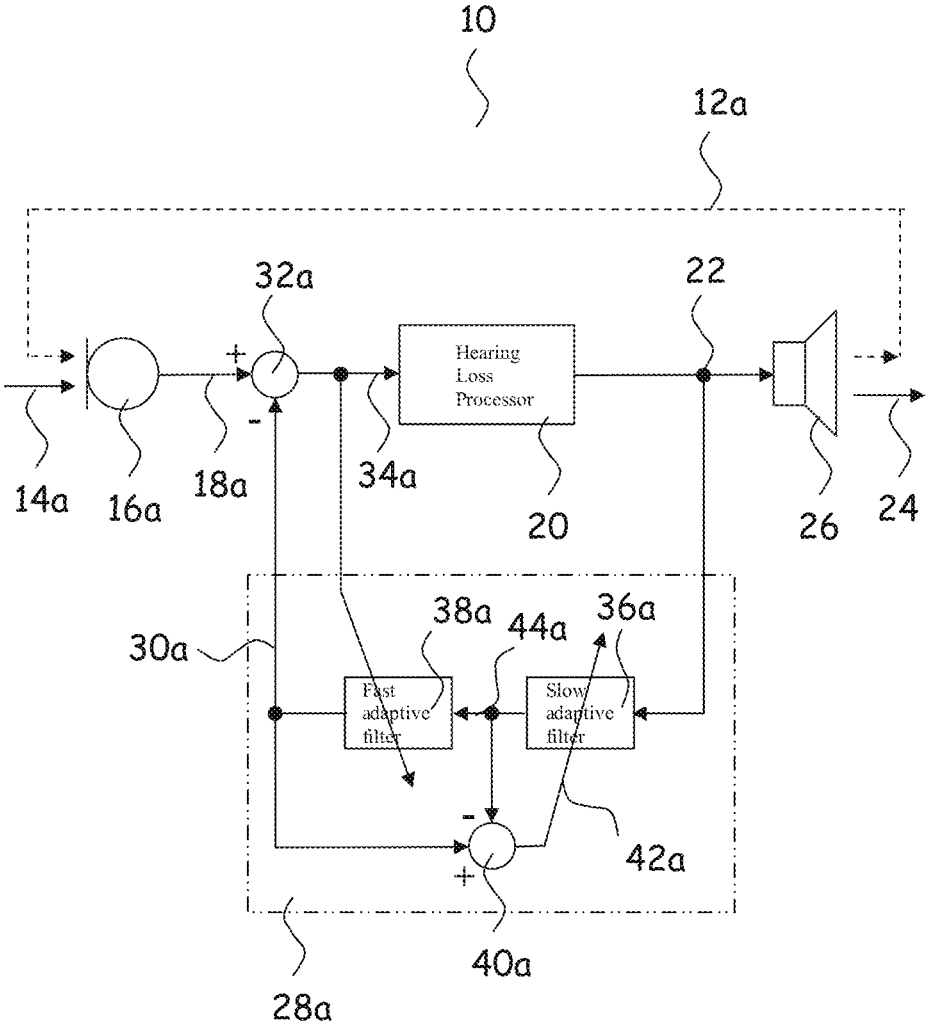

FIG. 3 shows a first example of a hearing aid 10 according to the appended claims. The hearing aid 10 has an input transducer, namely a microphone 16*a*, for generating an audio signal 18*a*, and feedback suppression circuit 28*a* that models the feedback path 12*a*, i.e. the feedback suppression circuit 28*a* seeks to generate a signal that is identical to the signal propagated along the feedback path 12*a*. It is noted that the feedback suppression circuit 28*a* includes models of the receiver 26 and the microphone 16*a* so that the transfer function of the feedback suppression circuit 28*a* desirably equals the sum of the transfer function of the receiver 26, the transfer function of the feedback path 12*a*, and the transfer function of the microphone 16*a*.

The feedback suppression circuit 28*a* generates an output signal 30*a* to the subtractor 32*a* in order to suppress or cancel the feedback signal part of the audio signal 18*a* before processing takes place in the hearing loss processor 20.

A hearing loss processor 20 is coupled to an output of the subtractor 32*a* for processing the feedback compensated audio signal 34*a* to perform hearing loss compensation, and a receiver 26 that is coupled to an output of the hearing loss processor 20 for converting the processed feedback compensated audio signal 22 into a sound signal.

The feedback suppression circuit 28*a* comprises a slow adaptive filter 36*a* with an input coupled to the output of the hearing loss processor 20 and an output, and a fast adaptive filter 38*a* with an input coupled to the output of the slow adaptive filter 36*a* and an output constituting the output of feedback suppression circuit 28*a*.

During normal operation of the illustrated hearing aid 10, the cancellation signal 30*a* in most situations constitutes a good estimate of the feedback signal part of the audio signal 18*a*, and therefore the slow adaptive filter 36*a* is connected for tracking the signal 30*a*, thus absorbing innovations from the fast adaptive filter 38*a*.

Thus, filter coefficients of the slow adaptive filter 36*a* are based, at least in part, on an error signal 42*a* equal to a difference output by subtractor 40*a* between an output signal 44*a* of the slow adaptive filter 36*a* and the cancellation signal 30*a* output by the fast adaptive filter 38*a*.

Filter coefficients of the fast adaptive filter 38*a* are based, at least in part, on the error signal 34*a* output by subtractor 32*a*.

With the slow adaptive filter 36*a*, it is not required to initialize the feedback suppression circuit 28*a*. Also, slow changes in the feedback path are adequately modelled by the slow adaptive filter 36*a*.

Figure 11:
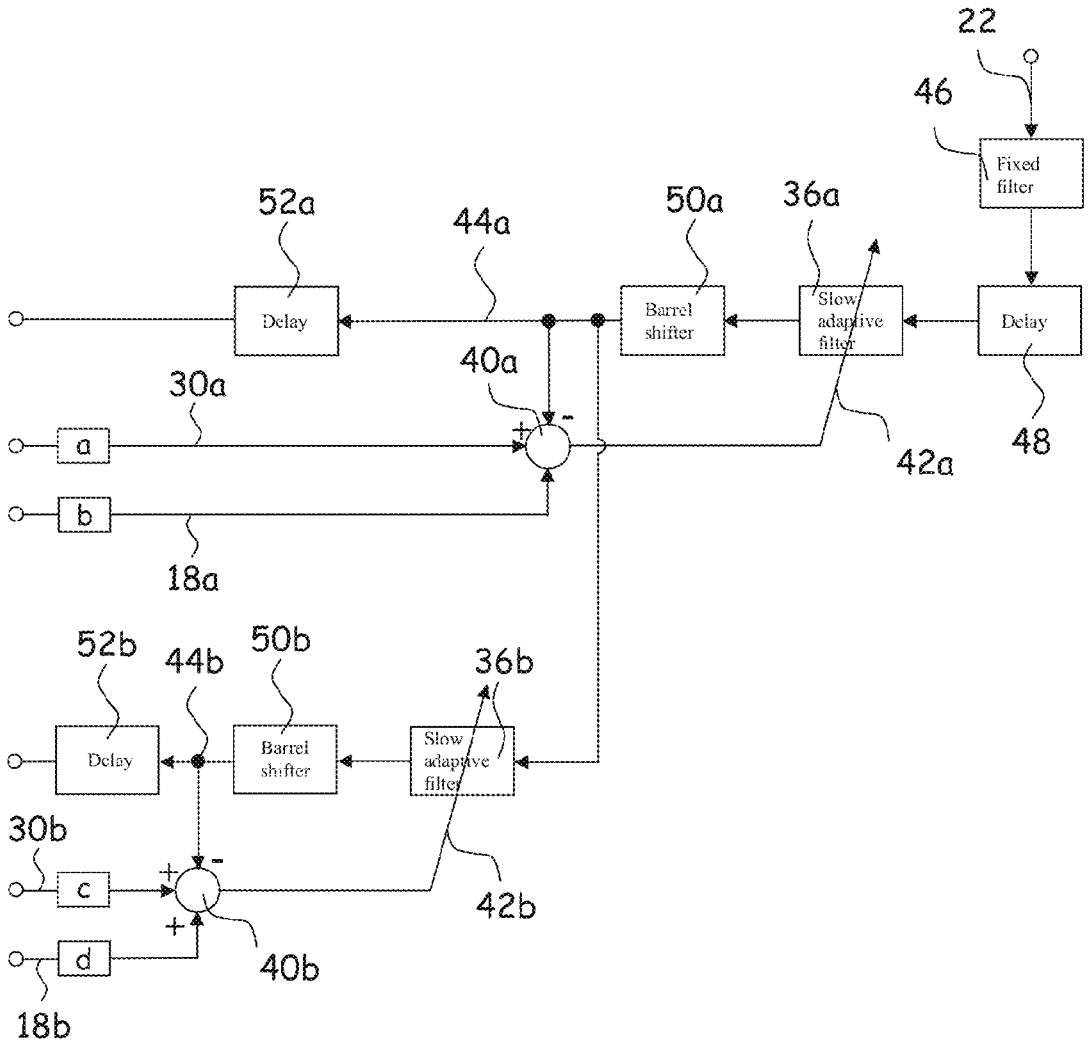

A fixed filter, see FIG. 11, may be connected in series with the slow adaptive filter 36*a* and the fast adaptive filter 38*a* configured for modelling true invariant parts of the feedback path 12*a*, such as initial values of the transfer function of the microphone 16*a*, the transfer function of an amplifier (not shown) driving the receiver 26, and the transfer function of the receiver 26, and a basic part of the feedback path 12*a*, so that the adaptive filters 36*a*, 38*a* are only required to cope with variations from the initial values.

A bulk delay, see FIG. 11, may be connected in series with the slow adaptive filter 36*a* and the fast adaptive filter 38*a* configured for modelling the propagation delay of the feedback signal propagating along the feedback path and thereby relieving the adaptive filters 36*a*, 38*a* of this task.

Barrel shifters, see FIG. 11, may be connected at the output of the slow adaptive filter 36*a* and/or the fast adaptive filter 38*a* in order to scale the output signals, preferably adaptively. Scaling, such as adaptive scaling, maximizes precision, and optionally extends the coefficient range, and also makes arbitrary slow adaptation possible. Without adaptive scaling, an optimal step size may not be available for all feedback paths.

Figure 4:
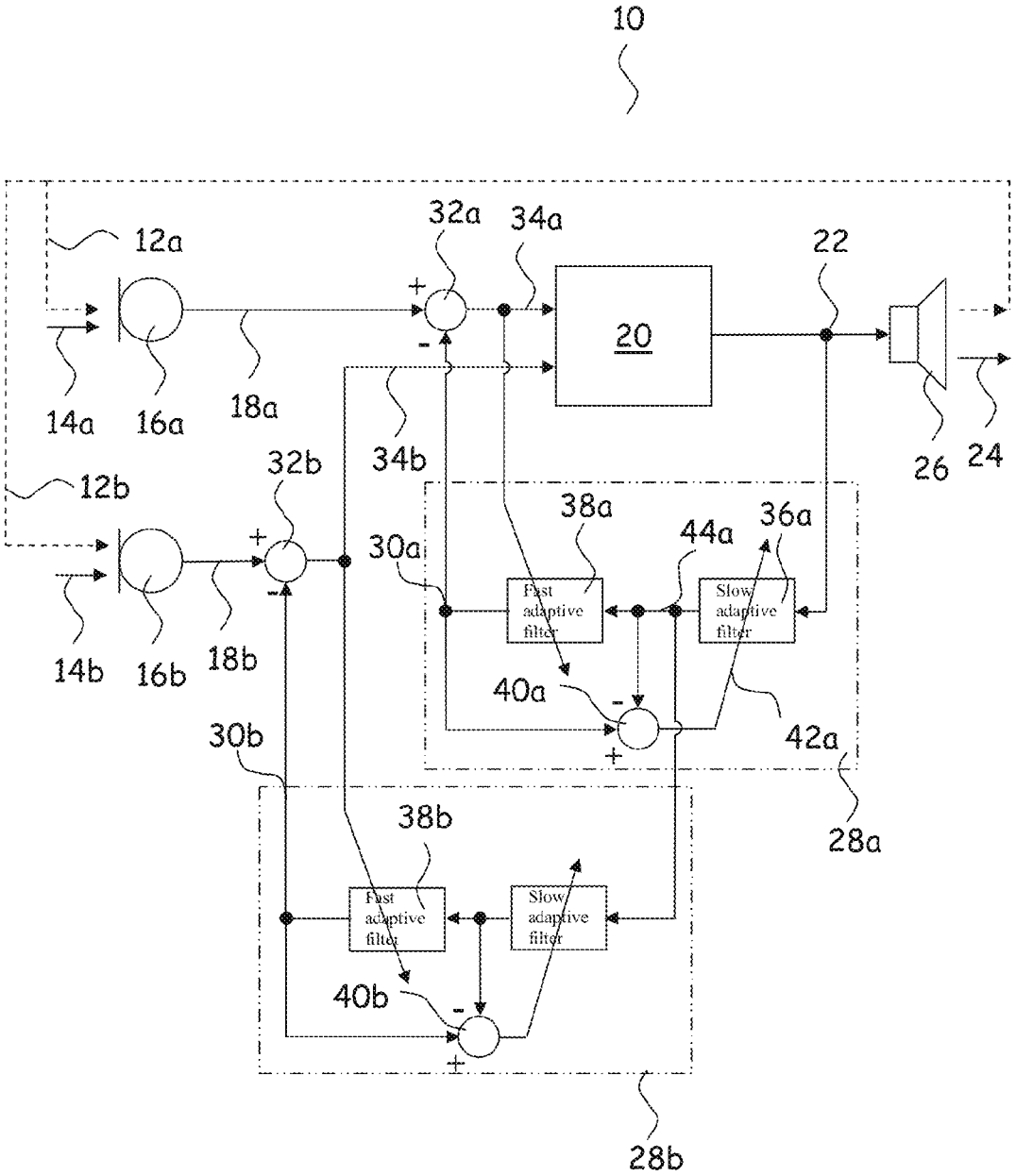

The hearing aid 10 shown in FIG. 4 is similar to the hearing aid of FIG. 3 except for the fact that the hearing aid 10 of FIG. 4 has two microphones 16*a*, 16*b*, namely a front microphone 16*a* and a rear microphone 16*b*, and the hearing loss processor 20 comprises a beamformer for selectable beamforming as is well-known in the art of hearing aids. The feedback path 12*a* to the front microphone 16*a* is modelled by first feedback suppression circuit 28*a* identical to the feedback circuit 28*a* shown in FIG. 3. Likewise, the feedback path 12*b* to the rear microphone 16*b* is modelled by second feedback suppression circuit 28*b* corresponding to the feedback circuit 28*a* shown in FIG. 3 except for the fact that the input of the second slow adaptive filter 36*b* is coupled to the output 44*a* of the first slow adaptive filter 36*a* instead of to the output 22 of the hearing loss processor 20.

In the illustrated hearing aid 10, the distance between the receiver 26 to the front microphone 12*a* is shorter than the distance between the receiver 26 and the rear microphone 12*b*. If the opposite is true, i.e. the distance between the receiver 26 and the rear microphone 12*b* is the shortest, then microphone 12*a* is the rear microphone and microphone 12*b* is the front microphone.

Thus, the first slow adaptive filter 36*a* models slow varying parts of the feedback path to the front microphone 12*a*, and the second slow adaptive filter 36*b* models the difference between the feedback path to front microphone 12*a* and the feedback path to rear microphone 12*b*, so that the series connection of the first slow adaptive filter 36*a* and the second slow adaptive filter 36*b* together model the feedback path to the rear microphone 12*b*. In the illustrated example, the distance between the front and rear microphones 16*a*, 16*b* is small, and the respective feedback paths 12*a*, 12*b* have similar transfer functions with sub-sample delay differences and minor differences in the shaping of the magnitude responses. Therefore, the second slow adaptive filter 36*b* is simpler than first slow adaptive filter 36*a*. The second slow adaptive filter 36*b* performs anti-causal interpolation made possible by bulk delays; see FIG. 11, of the feedback suppression circuits 28*a*, 28*b*.

In another example (not shown) in which the respective feedback paths 12*a*, 12*b* do not have similar transfer functions, the feedback paths 12*a*, 12*b* to the front microphone 16*a* and the rear microphone 16*b*, respectively, may be modelled by independent feedback circuits 28*a*, 28*b*, each of which is similar to the feedback circuit 28*a* shown in FIG. 3 with the inputs of both the first and the second slow adaptive filters 36*a*, 36*b* coupled to the output 22 of the hearing loss processor 20.

A first fixed filter, see FIG. 11, may be connected in series with the first slow adaptive filter 36*a* and the first fast adaptive filter 38*a* configured for modelling true invariant parts of the first feedback path 12*a*, such as initial values of the transfer function of the microphone 16*a*, the transfer function of an amplifier (not shown) driving the receiver 26, and the transfer function of the receiver 26, and a basic part of the first feedback path 12*a*, so that the first slow and fast adaptive filters 36*a*, 38*a* are only required to cope with variations from the initial values.

A second fixed filter, see FIG. 11, may be connected in series with the second slow adaptive filter 36*b* and the second fast adaptive filter 38*b* configured for modelling invariant parts of the second feedback path 12*b*, such as initial values of the transfer function of the microphone 16*b*, the transfer function of an amplifier (not shown) driving the receiver 26, and the transfer function of the receiver 26, and a basic part of the second feedback path 12*b*, so that the second slow and fast adaptive filters 36*b*, 38*b* are only required to cope with variations from the initial values.

Respective bulk delays, see FIG. 11, are connected in series with the slow adaptive filters 36*a*, 36*b* and the fast adaptive filters 38*a*, 38*b* configured for modelling the propagation delays of the respective feedback signals propagating along the feedback paths 12*a*, 12*b*, and thereby relieving the adaptive filters 36*a*, 36*b*, 38*a*, 38*b* of this task. The bulk delays are distributed to facilitate anti-causal interpolation in the second slow adaptive filter 36*b*.

Respective barrel shifters, see FIG. 11, are connected at the outputs of the slow adaptive filters 36*a*, 36*b* in order to adaptively scale the respective output signals 44*a*, 44*b*. Scaling maximizes precision, and optionally extends the coefficient range, and also makes arbitrary slow adaptation possible. Without adaptive scaling, an optimal step size may not be available for all feedback paths.

Figure 5:
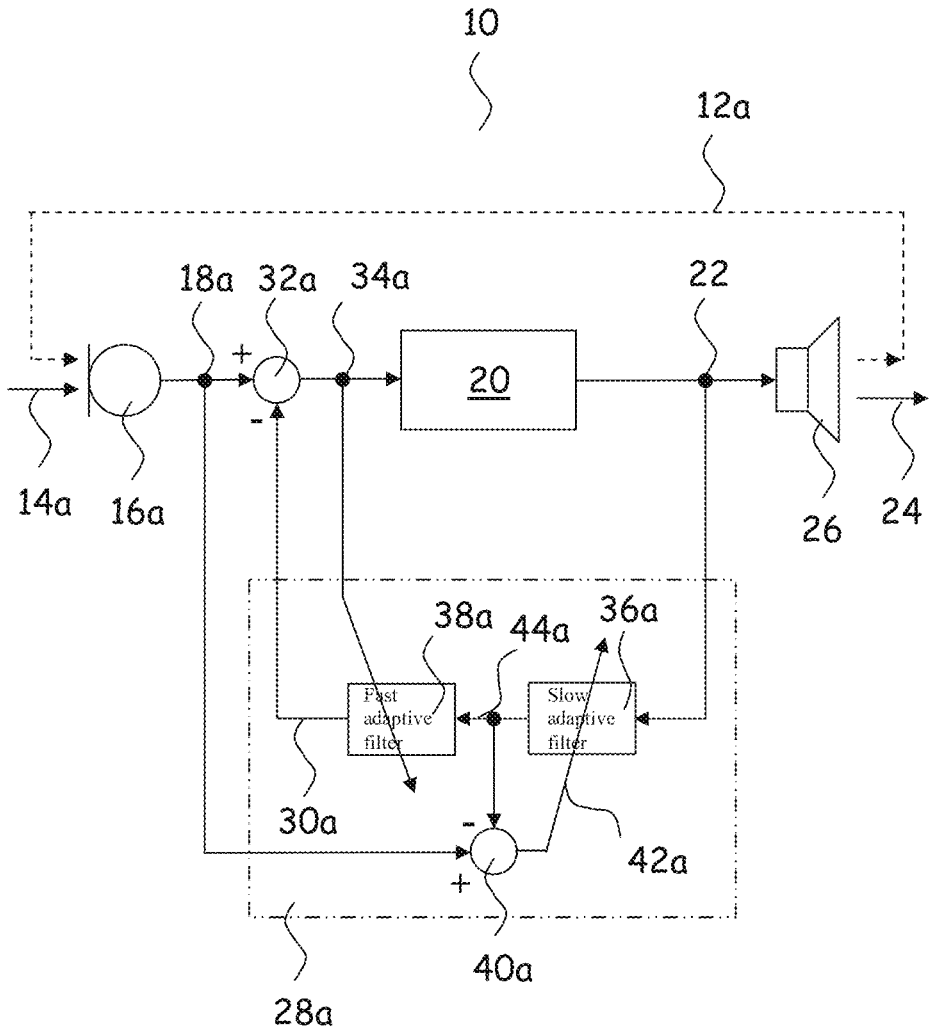

The hearing aid 10 shown in FIG. 5 is similar to the hearing aid of FIG. 3 except for the fact that the filter coefficients of slow adaptive filter 36*a* of the hearing aid 10 of FIG. 5 are based, at least in part, on an error signal 42*a* that is equal to a difference output by subtractor 40*a* between an output signal 44*a* of the slow adaptive filter 36*a* and the audio signal 18*a*; rather than being equal to a difference output by subtractor 40*a* between an output signal 44*a* of the slow adaptive filter 36*a* and the cancellation signal 30*a* output by the fast adaptive filter 38*a*.

The error signal 42*a* is also denoted a direct approach error and it is effectively the signal that would be the output of the feedback suppression circuit, if the fast adaptive filter was frozen in its reference state. The error signal 42*a* is optimal for uncorrelated signals, but may suffer more from bias caused by tonal input, whereas the error signal 42*a* of FIG. 3 is less sensitive to bias because the fast adaptive filter uses an adaptive signal model, but it may lead to local minima that may trap the slow adaptive filter preventing it for further adaptation.

Figure 6:
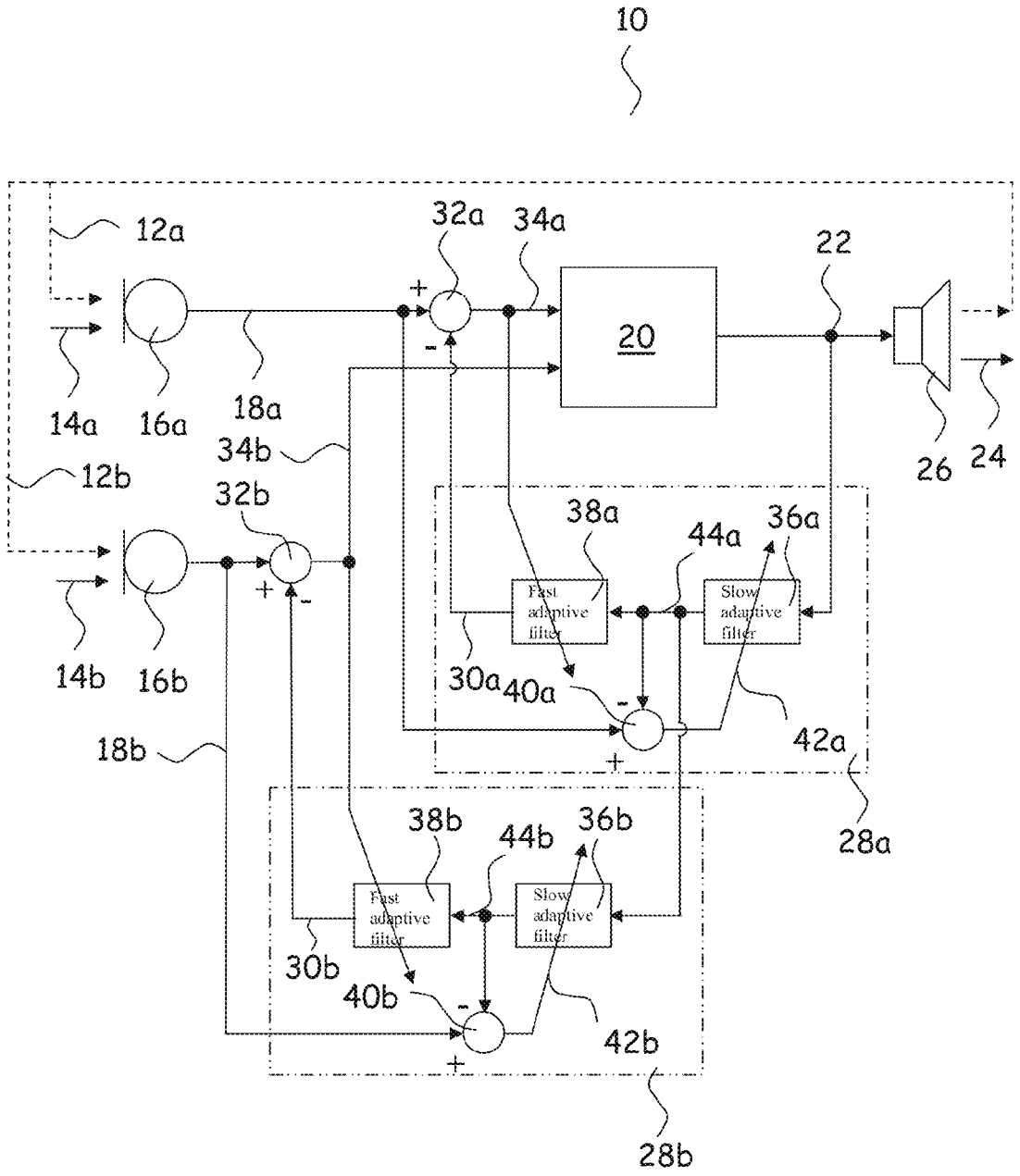

The hearing aid 10 shown in FIG. 6 is similar to the hearing aid of FIG. 4 except for the fact that as in FIG. 5, the filter coefficients of first slow adaptive filter 36*a* of the hearing aid 10 of FIG. 5 are based, at least in part, on a first error signal 42*a* equal to a difference output by first subtractor 40*a* between a first output signal 44*a* of the first slow adaptive filter 36*a* and the first audio signal 18*a*; rather than being equal to a difference output by first subtractor 40*a* between a first output signal 44*a* of the first slow adaptive filter 36*a* and the first cancellation signal 30*a* output by the first fast adaptive filter 38*a*. Likewise, the filter coefficients of second slow adaptive filter 36*b* are based, at least in part, on second error signal 42*b* equal to a difference output by second subtractor 40*b* between a second output signal 44*b* of the second slow adaptive filter 36*b* and the second audio signal 18*b*; rather than being equal to a difference output by second subtractor 40*b* between a second output signal 44*b* of the second slow adaptive filter 36*b* and the second cancellation signal 30*b* output by the second fast adaptive filter 38*b*.

Figure 7:
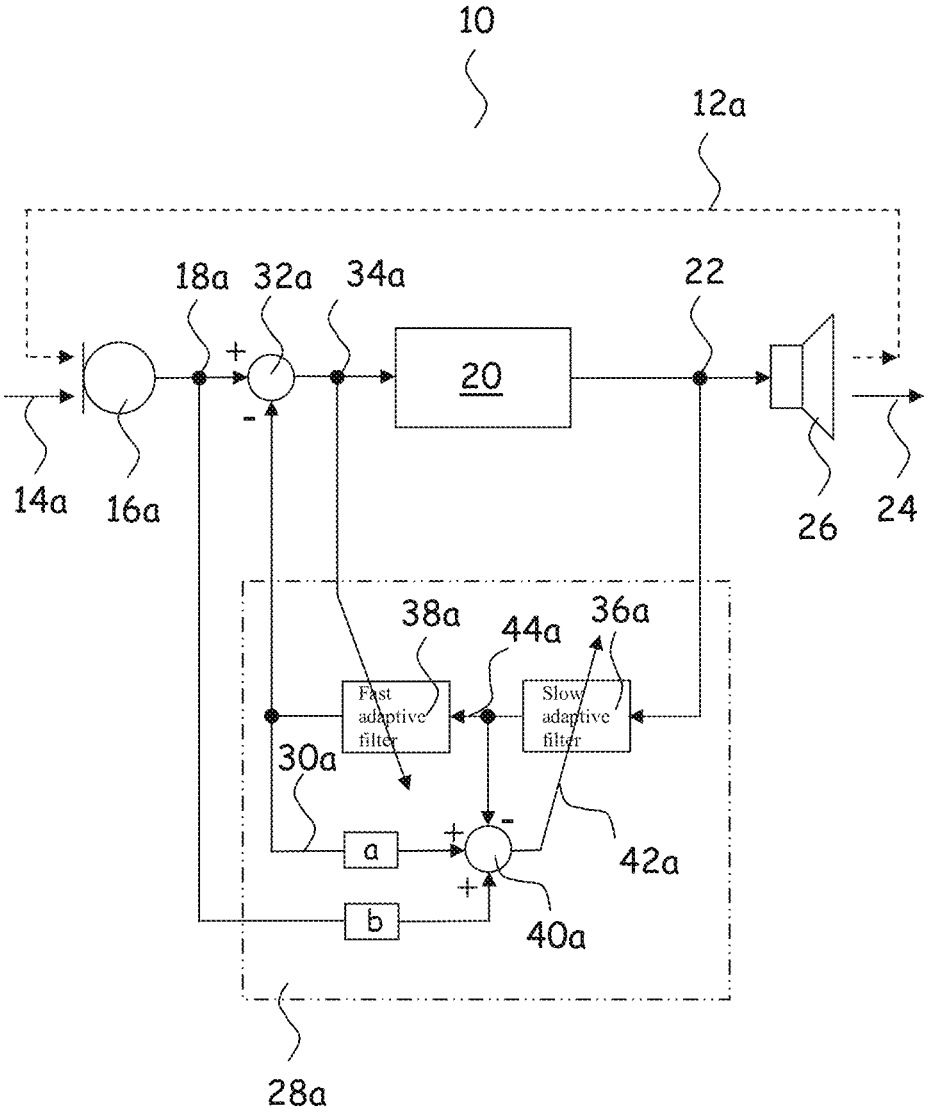

The hearing aid 10 shown in FIG. 7 combines the error signals 42*a* shown in FIGS. 3 and 5, respectively. Thus, the hearing aid 10 shown in FIG. 7 is similar to the hearing aid of FIG. 3 except for the fact that the filter coefficients of slow adaptive filter 36*a* of the hearing aid 10 of FIG. 7 are based, at least in part, on an error signal 42*a* that is equal to a difference output by subtractor 40*a* between an output signal 44*a* of the slow adaptive filter 36*a* and a weighted sum of the audio signal 18*a* and the cancellation signal 30*a* output by the fast adaptive filter 38*a*; rather than being equal to a difference output by subtractor 40*a* between an output signal 44*a* of the slow adaptive filter 36*a* and the cancellation signal 30*a* output by the fast adaptive filter 38*a*.

Figure 8:
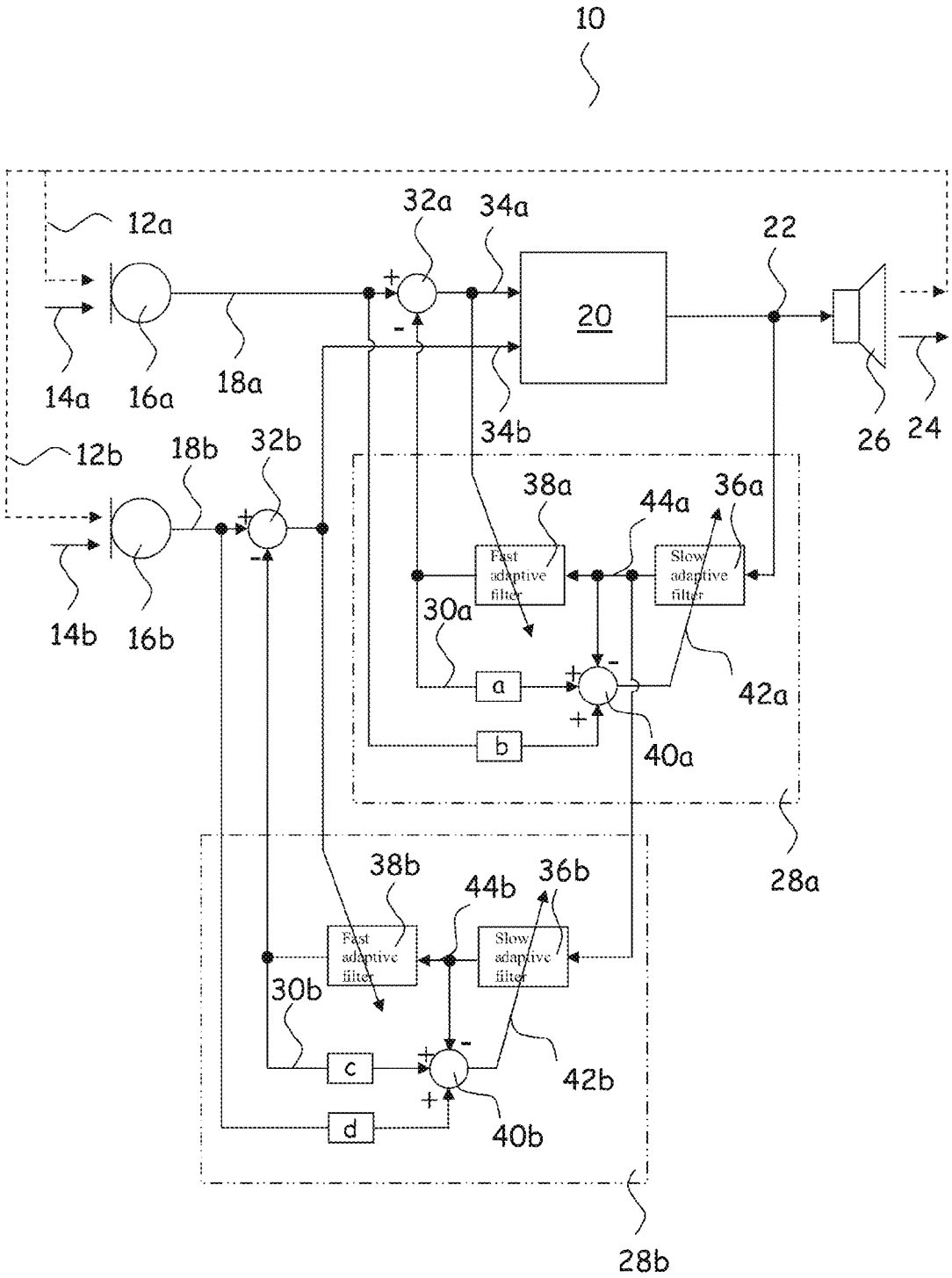

The hearing aid 10 shown in FIG. 8 is similar to the hearing aid of FIG. 4 or 6 except for the fact that as in FIG. 7, the filter coefficients of the first slow adaptive filter 36*a* of the hearing aid 10 of FIG. 7 are based, at least in part, on a first error signal 42*a* that is equal to a difference output by first subtractor 40*a* between a first output signal 44*a* of the first slow adaptive filter 36*a* and a weighted sum of the first audio signal 18*a* and the first cancellation signal 30*a* output by first fast adaptive filter 38*a*. Likewise, the filter coefficients of second slow adaptive filter 36*b* are based, at least in part, on second error signal 42*b* equal to a difference output by second subtractor 40*b* between a second output signal 44*b* of the second slow adaptive filter 36*b* and a weighted sum of second audio signal 18*b* and second cancellation signal 30*b* output by second fast adaptive filter 38*b*.

Figure 9:
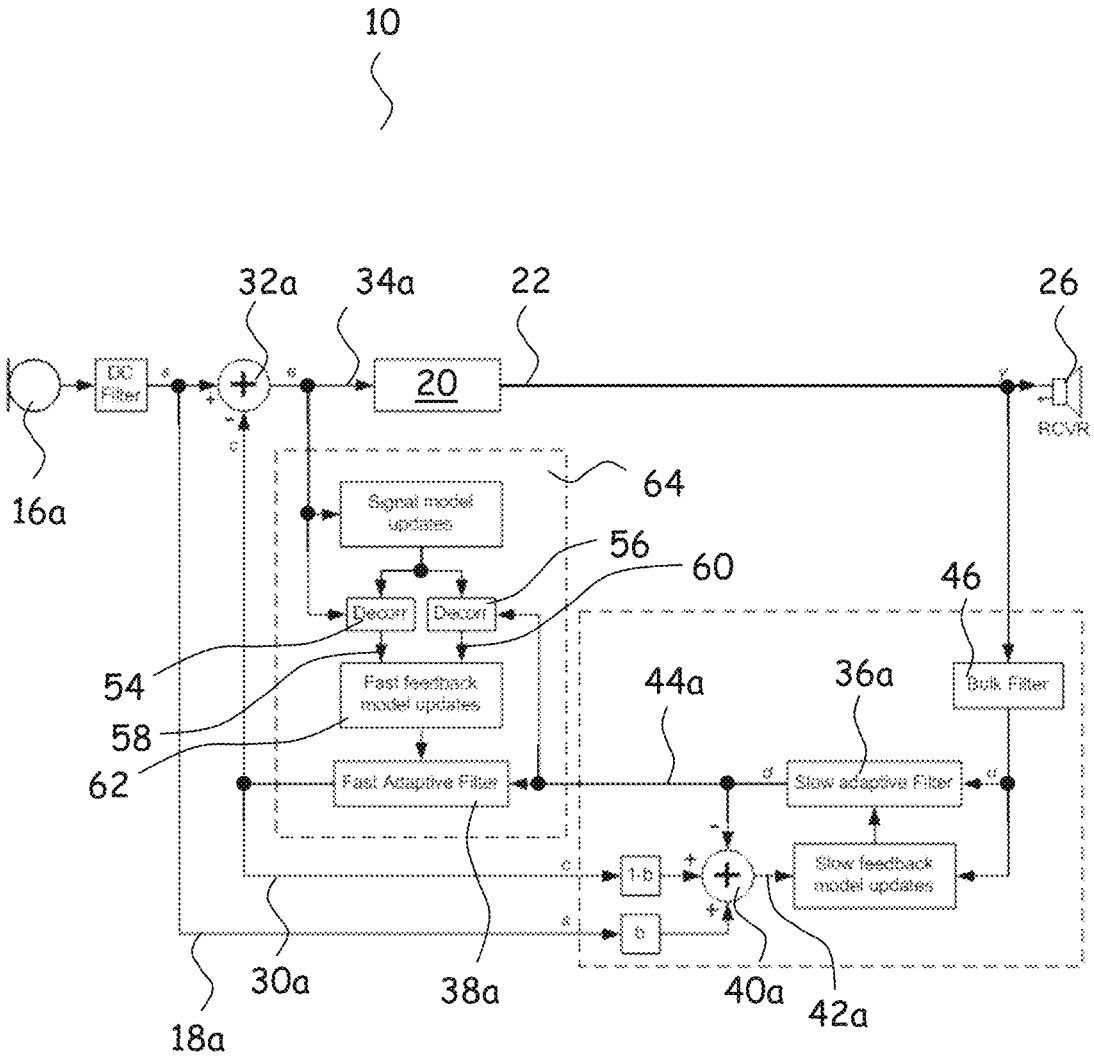

FIG. 9 shows a hearing aid 10 according to the appended claims, having a fast adaptive filter 38*a* included in signal modelling circuitry 64. The signal modelling circuitry 64 may substitute the adaptive filters 38*a*, 38*b* of the hearing aids shown in FIGS. 3-8.

The fast adaptive filters 38*a*, 38*b* shown in FIGS. 3-8 operate according to the so-called "direct approach" to minimize the expected signal strength of the error signal 34*a*, 34*b*. The "direct approach" is well-known in the art of hearing aids, and the minimization of the error signal is typically performed using the least mean squares (LMS) algorithm, the normalized least mean squares (NLMS) algorithm, preferably the Block Normalized Least Mean Squares (BNLMS) algorithm, wherein the square error criterion is minimized over a block of samples.

The direct approach is known to provide biased results when the input signal exhibits a long-tailed auto-correlation function. In the case of tonal signals, for example, this typically leads to sub-optimal solutions because the adaptive feedback model will attempt to suppress the external tones instead of modelling the actual feedback.

This problem is solved with the signal modelling circuitry 64 shown in FIG. 9 comprising de-correlation circuits 54, 56 that ensure stability in the presence of tonal input.

De-correlation circuit 54 applies adaptive de-correlation to error signal 34*a* to obtain filtered error signal 58. De-correlation circuit 56 applies adaptive de-correlation symmetrically to fast adaptive filter input 44*a* to obtain filtered input 60 so that cross-correlating both signals in algorithm block 62 provides a gradient estimate to minimize the filtered error criterion, which is known to be more robust for tonal or self-correlated external signals. In the illustrated signal modelling circuitry 64, the signal model used in the de-correlation filters 54, 56 is obtained from error signal 34*a*. However, a fixed de-correlation filter may alternatively be used.

The signal modelling circuitry 64 may further be configured for maintaining a statistical model of the external signal 18*a* for distinguishing correlations between the hearing aid output and input caused by feedback from correlations already present in the external signal (tonal input) whereby sensitivity to tonal input is reduced.

Figure 10:
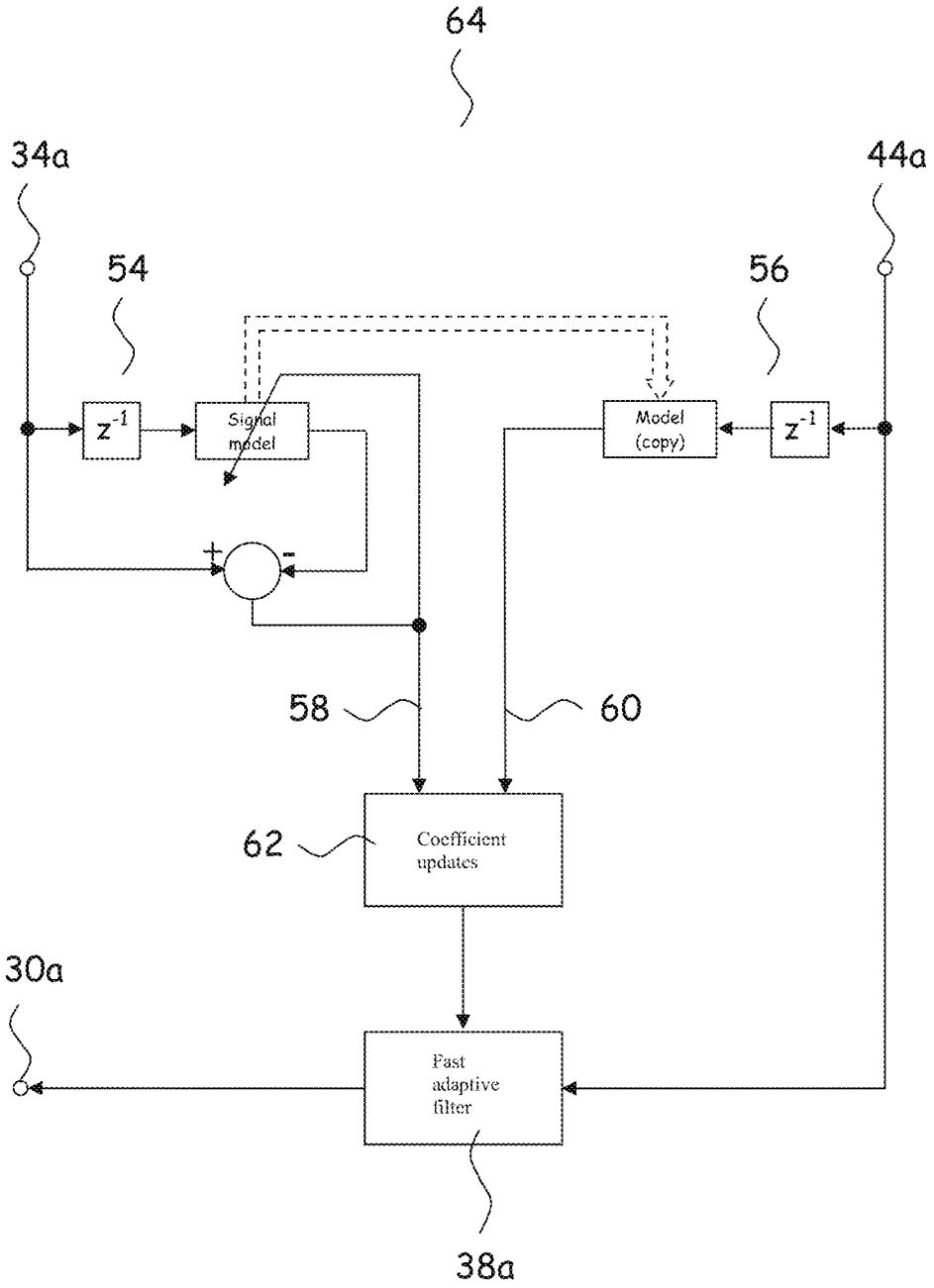

FIG. 10 shows an embodiment of the signal modelling circuitry 64 in more detail. The illustrated signal modelling circuitry 64 comprises adaptive de-correlation circuits 54, 56. Adaptive de-correlation is applied to the error signal 34*a* to obtain the filtered error signal 58. Further, adaptive de-correlation is applied symmetrically to the input 44*a* to the fast adaptive filter 38*a*, i.e. the filter of de-correlation circuit 56 is identical to the filter of de-correlation circuit 54, so that cross-correlating the de-correlated signals 58, 60 in algorithm 62 provides a gradient estimate to minimize the filtered error criterion, which is known to be more robust with tonal or self-correlated external signal conditions.

The de-correlation filters subtract a linear prediction of the signal after cancellation (which ideally matches the external signal). In some sense it is quite similar to the well-known Linear Predictive Coding, except that in the present circuitry, the models are updated incrementally. Standard FIR filters are used for the linear prediction, so consequently the generating model (for the external signal) is IIR and can be interpreted as an Auto-Regressive model. However, it is not necessary to restrict to Auto-Regressive models; e.g., Autoregressive-moving-average models (ARMA) could also be used, although extra care may be needed to ensure stability and efficiency.

Fixed de-correlation filters may alternatively be used in the signal modelling circuitry 64.

Further, adaptive non-linear de-correlation may be applied in the signal path. Non-linear de-correlation in the signal path decreases the correlation of the external signal with the hearing aid output. The contribution to the input signal caused by feedback remains equally correlated (because the applied non-linearity is known) so it becomes easier to distinguish feedback from tonal input and consequently the feedback models will improve.

FIG. 11 shows a feedback suppression circuit except the fast adaptive filters. Some or all of the illustrated fixed filter 46, the delays 48, 52*a*, 52*b*, and the barrel shifters 50*a*, 50*b* may be included in the feedback suppression circuits 28 shown in FIGS. 3-8.

The output 22 of the hearing loss processor (not shown) is input to a fixed filter 46 connected in series with the first slow adaptive filter 36*a* and the first fast adaptive filter (not shown). The fixed filter 46 is configured for modelling true invariant parts of the feedback path (not shown), such as initial values of the transfer function of the microphone (not shown), the transfer function of an amplifier (not shown) driving the receiver (not shown), and the transfer function of the receiver (not shown), and a basic part of the feedback path (not shown), so that the adaptive filters of the feedback suppression circuit are only required to cope with variations from the initial values.

Bulk delays 48, 52*a*, 52*b* are connected in series with the slow adaptive filters 36*a*, 36*b* and the fast adaptive filters (not shown) configured for modelling the propagation delays of the respective feedback signals propagating along respective feedback paths (not shown) and thereby relieving the adaptive filters of the feedback suppression circuit of this task. The bulk delays are distributed to facilitate anti-causal interpolation in the second slow adaptive filter 36*b*.

Barrel shifters 50*a*, 50*b* are connected at the respective outputs of the first and second slow adaptive filters 36*a*, 36*b* in order to adaptively scale the respective output signals 44*a*, 44*b*. Scaling maximizes precision, and optionally extends the coefficient range, and also makes arbitrary slow adaptation possible. Without adaptive scaling, an optimal step size may not be available for all feedback paths.

Figure 12:
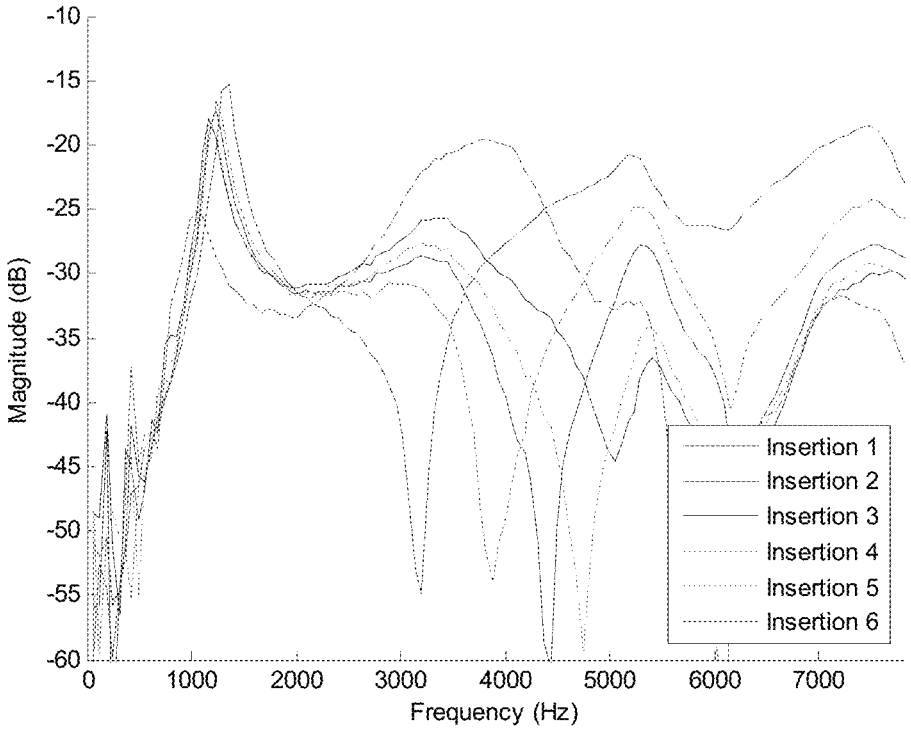
FIG. 12 shows plots of feedback path transfer functions upon repeated re-insertions.

FIG. 12 shows plots of feedback path transfer functions upon repeated re-insertions for illustration of variations of the feedback path modelled by the slow adaptive filter.

Figure 13:
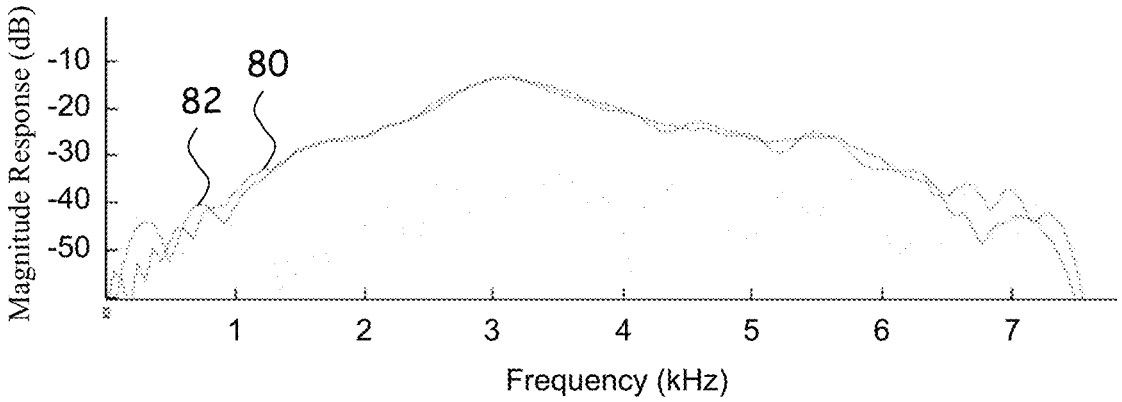
FIG. 13 shows a plot of slow filter feedback path modelling performance.

FIG. 13 shows plots of transfer functions of the feedback path 80 and the model 82 learned by the slow adaptive filter after 60 seconds of speech.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

a first input transducer for generating a first audio signal;

a first feedback suppression circuit configured for modelling a first feedback path of the hearing aid;

a first subtractor for subtracting a first output signal of the first feedback suppression circuit from the first audio signal to form a first feedback compensated audio signal;

a hearing loss processor that is coupled to the first subtractor for processing the first feedback compensated audio signal to perform hearing loss compensation; and a receiver that is coupled to the hearing loss processor for providing a sound signal based on the processed first feedback compensated audio signal, wherein the first feedback suppression circuit comprises a first slow adaptive filter with an input coupled to the hearing loss processor, and an output, the first slow adaptive filter configured to model a first change of the first feedback path, and a first fast adaptive filter with an input coupled to the first slow adaptive filter, and an output, the first fast adaptive filter configured to model a second change of the first feedback path, the second change being a faster change compared to the first change, wherein filter coefficients of the first slow adaptive filter are based at least in part on a difference between an output signal of the first slow adaptive filter and at least one of an output signal of the first fast adaptive filter and the first audio signal.

2. The hearing aid according to claim 1, wherein the filter coefficients of the first slow adaptive filter are based on a difference between the output signal of the first slow adaptive filter and the first audio signal.

3. The hearing aid according to claim 1, wherein the filter coefficients of the first slow adaptive filter are based on a difference between the output signal of the first slow adaptive filter and the output signal of first fast adaptive filter.

4. The hearing aid according to claim 1, wherein the filter coefficients of the first slow adaptive filter are based on a difference between the output signal of the first slow adaptive filter and a weighted sum of the output signal of the first fast adaptive filter and the first audio signal.

5. The hearing aid according to claim 1, further comprising:

a second input transducer for generating a second audio signal;

a second feedback suppression circuit configured for modelling a second feedback path of the hearing aid;

a second subtractor for subtracting a second output signal of the second feedback suppression circuit from the second audio signal to form a second feedback compensated audio signal;

wherein the hearing loss processor is coupled to the second subtractor for processing the second feedback compensated audio signal to perform hearing loss compensation; and wherein the second feedback suppression circuit comprises a second slow adaptive filter with an input coupled to the hearing loss processor, and an output, and a second fast adaptive filter with an input coupled to the second slow adaptive filter, and an output, wherein filter coefficients of the second slow adaptive filter are based at least in part on a difference between an output signal of the second slow adaptive filter and at least one of an output signal of the second fast adaptive filter and the second audio signal.

6. The hearing aid according to claim 1, further comprising:

a second input transducer for generating a second audio signal;

a second feedback suppression circuit configured for modelling a second feedback path of the hearing aid;

a second subtractor for subtracting a second output signal of the second feedback suppression circuit from the second audio signal to form a second feedback compensated audio signal;

wherein the hearing loss processor is coupled to the second subtractor for processing the second feedback compensated audio signal to perform hearing loss compensation; and wherein the second feedback suppression circuit comprises:

a second slow adaptive filter with an input coupled to the first slow adaptive filter, and an output, and a second fast adaptive filter with an input coupled to the second slow adaptive filter, and an output, wherein filter coefficients of the second slow adaptive filter are based at least in part on a difference between an output signal of the second slow adaptive filter and at least one of an output signal of the second fast adaptive filter and the second audio signal.

7. The hearing aid according to claim 5, wherein the filter coefficients of the second slow adaptive filter are based on a difference between the output signal of the second slow adaptive filter and the second audio signal.

8. The hearing aid according to claim 5, wherein the filter coefficients of the second slow adaptive filter are based on a difference between the output signal of the second slow adaptive filter and the output signal of second fast adaptive filter.

9. The hearing aid according to claim 5, wherein the filter coefficients of the second slow adaptive filter are based on a difference between the output signal of the second slow adaptive filter and a weighted sum of the output signal of the second fast adaptive filter and the second audio signal.

10. The hearing aid according to claim 1, wherein the first slow adaptive filter is configured to adjust one or more of the filter coefficients when at least one criteria is fulfilled.

11. The hearing aid according to claim 10, wherein the at least one criteria comprises a signal level of an input signal of the first feedback suppression circuit being larger than a predefined threshold.

12. The hearing aid according to claim 10, wherein the at least one criteria comprises an autocorrelation of an error signal being below a predetermined threshold.

13. The hearing aid according to claim 10, wherein the at least one criteria comprises that updating constitutes a first update performed immediately upon power-up of the hearing aid.

14. The hearing aid according to claim 10, wherein the at least one criteria comprises a p-norm of a filter coefficient vector of the first fast adaptive filter being less than a predetermined threshold value.

* * * * *